United States Patent [19]

Jarrett et al.

[11] 4,401,084

[45] Aug. 30, 1983

[54] FUEL INJECTION PUMPING APPARATUS

[75] Inventors: Boaz A. Jarrett, London; Dorian F. Mowbray, Burnham, both of England

[73] Assignee: Lucas Industries Limited, Birmingham, England

[21] Appl. No.: 304,894

[22] Filed: Sep. 23, 1981

[30] Foreign Application Priority Data

Nov. 1, 1980 [GB] United Kingdom ..... 8035191

[51] Int. Cl.[3] ..... F02M 39/00; F04B 23/10

[52] U.S. Cl. ..... 123/450; 123/179 L; 417/462

[58] Field of Search ..... 417/462, 463, 429, 215, 417/216; 123/450, 179 L

[56] References Cited

U.S. PATENT DOCUMENTS 4,242,059 12/1980 Mowbray ..... 417/462

4,299,542 11/1981 Potter ..... 417/462

*Primary Examiner*—Charles J. Myhre

*Assistant Examiner*—Carl Stuart Miller

[57] ABSTRACT

A liquid fuel injection pumping apparatus of the rotary distributor type has two forms of cam lobe on its cam ring. The first form of cam lobe is a pumping lobe which can effect inward movement of a plunger to achieve pumping of fuel and after the crest of the lobe has been passed allows outward movement of the plunger to lower the fuel pressure in the various passages in the apparatus. The other form of lobe is a holding lobe which while one plunger is being moved inwardly holds another plunger against movement. When the crest of the holding lobe is reached the associated plunger is allowed to move outwardly and this movement is arranged to take place shortly before the end of the inward movement of the plunger associated with a pumping lobe. The effect is to reduce the period towards the end of fuel delivery at which fuel is supplied at a reducing rate.

1 Claim, 3 Drawing Figures

FUEL INJECTION PUMPING APPARATUS

This invention relates to a Fuel Injection Pumping Apparatus for supplying fuel to an Internal Combustion Engine and of the kind comprising a rotary distributor member carried in a surrounding housing, a pair of pumping plungers housed in respective bores in said distributor member, said bores being interconnected at their inner ends, an annular cam ring surrounding the distributor member, cam lobes on the internal peripheral surface of the cam ring for imparting inward movement to rollers associated with the plungers as the distributor member rotates, delivery passage means through which fuel displaced from the bores during the inward movement of the plungers therein can flow to the associated engine and inlet passage means through which fuel can be supplied to the bores from a source of fuel under pressure.

Such apparatus is well known in the art. The shape of the injection diagram is dictated by the profiles of the leading flanks of the cam lobes, the injection diagram being the displacement of fuel from the bore plotted against rotation of the distributor member. The shape of the injection diagram has a bearing on the exhaust emission and the fuel consumption of the associated engine. In some engines it appears desirable to reduce the duration of the period at the end of the period of fuel delivery during which delivery of fuel is at a reduced rate. This period is determined by the profile of the leading flanks of the cam lobes and particularly the portion leading to the crests of the cam lobes. Mechanical considerations dictate the minimum radius of the crest of a cam lobe so that little if any benefit can be obtained by altering the cam lobe since this usually has as small a radius as possible in order to achieve a rapid reduction in the pressure within the bores and connected passage means once the roller has moved over the crest of the cam lobe.

The object of the present invention is to provide an apparatus of the kind specified in a simple and convenient form.

According to the invention in an apparatus of the kind specified, said cam lobes are arranged so that one of said plungers is held against movement while the other plunger partakes of inward movement to cause delivery of fuel by the apparatus, said cam means being arranged to allow said one plunger to move outwardly before the other plunger has completed its inward movement.

An example of a fuel pumping apparatus in accordance with the invention will now be described with reference to the accompanying drawings in which.

Figure 1:
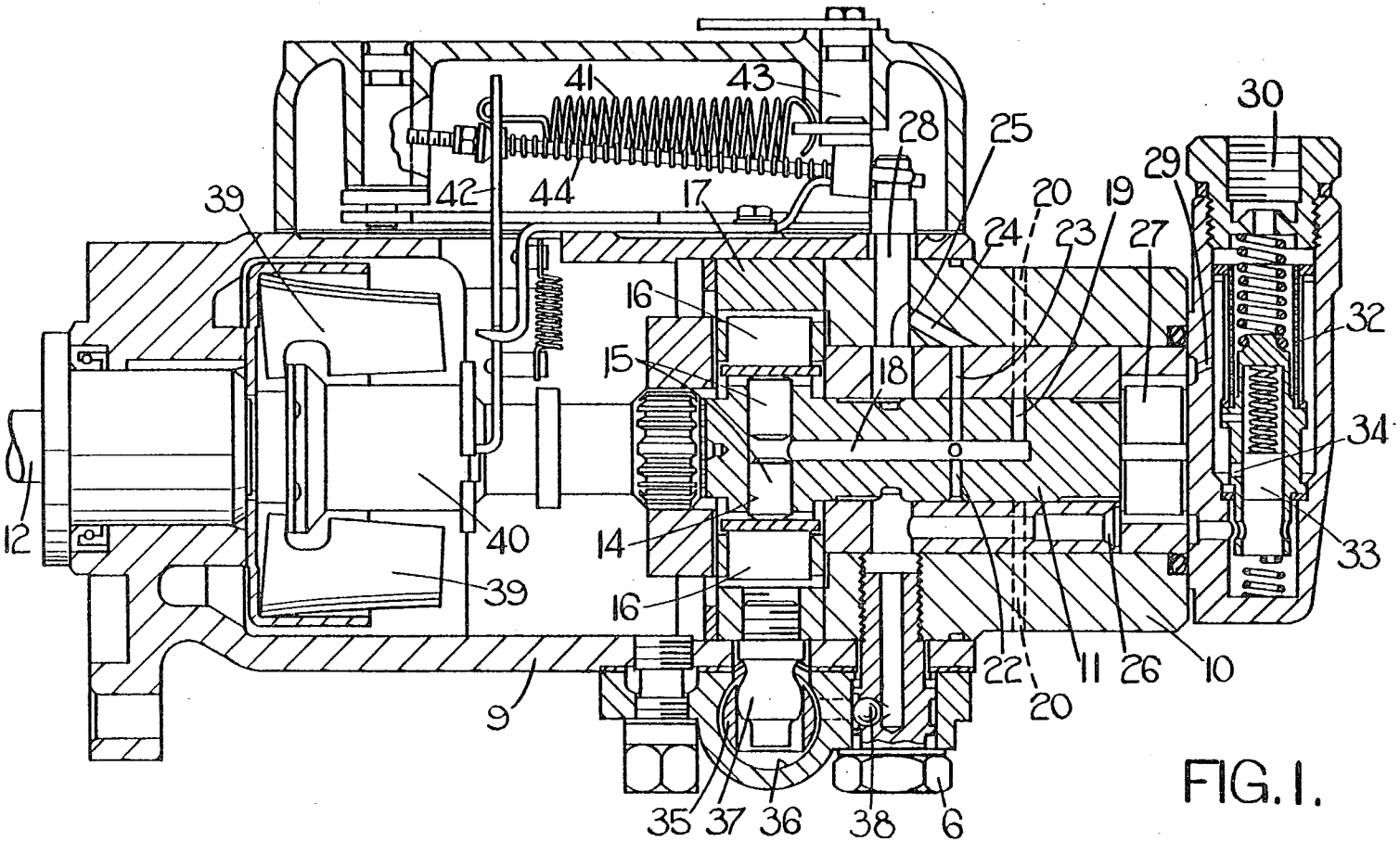
FIG. 1 is a known form of pumping apparatus.

Referring to FIG. 1 of the drawings the known form of apparatus comprises a two part housing 9, 10 the housing part 9 being provided with an open end in which is located the part 10 of the housing.

Formed within the part 10 of the housing is a bore in which is mounted a rotary distributor member 11 and this is coupled to an input shaft 12 which is located in the part 9 of the housing. The shaft 12 is adapted to be driven in timed relationship with an engine with which the apparatus is associated. Formed within the distributor member is a transversely extending bore 14 in which is mounted a pair of reciprocable plungers 15 arranged to be moved inwardly as the distributor member rotates, through the intermediary of a pair of rollers 16 respectively, by cam lobes (not shown) but formed on an annular cam ring 17 mounted for angular movement within the part 9 of the housing.

Also formed in the distributor member 11 is a longitudinally extending passage 18 which at one end is in communication with the transverse bore and at its other end is in communication with a radially disposed delivery passage 19. The delivery passage 19 is arranged to register in turn with a plurality of equi-angularly spaced outlet ports constituted as shown in the drawing, by passages 20. The outlet ports in use, are connected by pipe lines respectively to injection nozzles mounted on the associated engine. The aforesaid registration of the passage 19 with an outlet port takes place during the whole time the plungers 15 are being moved inwardly so that liquid fuel contained in the transverse bore 14 will be displaced to a combustion space of the engine.

At another point the longitudinal passage 18 is in communication with a plurality of equi-angularly spaced and radially disposed inlet passages 22 which are arranged to register in turn with an inlet port 23 formed in the part 10 of the housing. The inlet port 23 is in communication with a control port 25 by way of a passage 24 and the control port is in communication with the outlet 26 of a feed pump 27.

The effective size of the control port 25 can be varied by varying the angular setting of a valve member 28 which has a groove formed therein and the arrangement is such that when an inlet passage 22 registers with the inlet port 23 fuel will flow from the outlet of the feed pump to the transverse bore 14 to move the plungers 15 outwardly. The aforesaid registration takes place during the time when the delivery passage 19 is out of register with a passage 20 and during the time when the rollers 16 are clear of the cam lobes. By adjusting the setting of the valve member 28, the rate at which fuel can flow to the bore 14 can be controlled and hence also the amount of fuel supplied to the engine.

The feed pump 27 is provided with an inlet which is in communication with an inlet port 30 formed in a hollow part which is secured to the part 10 of the housing. The inlet communicates with the inlet port 30 by way of a passage 29 also formed in the part. The part has mounted therein a tubular filter element 32 and a relief valve which includes a spring loaded element 33. One end of the element 33 is exposed to the pressure of fuel delivered by the feed pump and it controls the size of a spill port 34. The arrangement is such that the feed pump always pumps more fuel than is delivered to the engine with the result that the output pressure of the feed pump is controlled in a manner which is dependent upon the speed of the engine and which increases with the speed thereof.

As previously mentioned the cam ring 17 is angularly adjustable so that the timing of delivery of fuel to the engine can be varied. This adjustment is achieved by a spring loaded piston 35 mounted in a cylinder 36. The piston is connected to the cam ring by means of a pin or peg 37 which is in screw thread engagement with the cam ring. Fuel is supplied to one end of the cylinder 36 to move the piston in opposition to its spring, from the outlet of the feed pump and since the pressure of fuel is dependent upon the speed of rotation of the engine, the angular setting of the cam ring and hence the timing of injection of fuel to the engine is also dependent upon the speed of the engine. The piston 35 defines with the wall of the cylinder 36 a leakage path so that fuel can leak from the cylinder and a check valve 38 is incorporated in the supply passage and this closes to prevent fuel passing from the cylinder to the supply passage due to the reaction of the rollers 16 with the cam lobes.

The angular setting of the valve member 28 is conveniently controlled by a mechanical governor which includes weights 39 accommodated in a cage driven by the shaft 12. The weights act upon an axially movable flanged collar 40 mounted about the drive shaft 12, and the axial movement of the collar is resisted by a governor spring 41 which is mounted between one end of a pivotal lever 42 and an operator adjustable member 43. The other end of the lever 42 engages the collar 40. Furthermore, said one end of the lever 42 is connected by a tie rod 44 to the valve member 28 and the arrangement is such that as the speed of rotation of the engine increases the collar 40 will be moved axially by the weights against the action of the governor spring and during this movement the member 28 will be moved angularly to reduce the quantity of fuel delivered to the engine.

Figure 3:
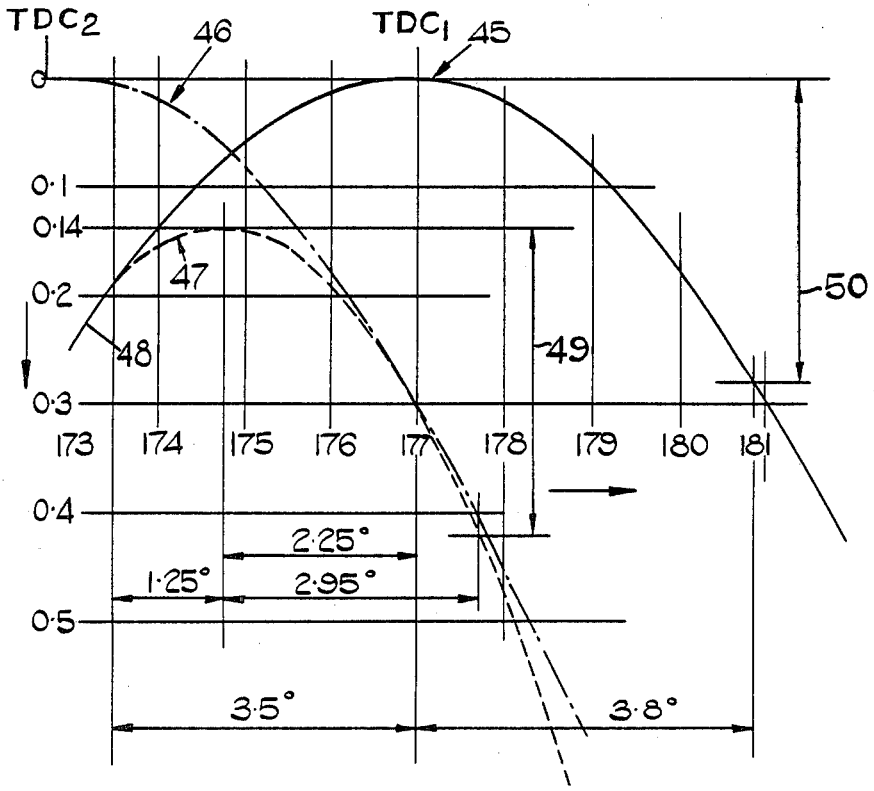
FIG. 3 is a graph to demonstrate the operation of the modified apparatus.

As previously mentioned the shape of the injection diagram is determined by the shape of the leading flanks of the cam lobes. In FIG. 3 there is shown in solid outline the profile of the crest portion of a cam lobe. The minimum radius of the crest of the lobe is determined by mechanical considerations and as a result it is not possible to reduce to any significant extent the final period of inward movement of the plunger and during which time the rate of fuel delivery is reducing.

In order to reduce the aforesaid period it is proposed to modify the operation of one of the plungers so that during the final inward movement of the other plunger, the one plunger is moving outwardly. Moreover, the one plunger is held against inward and outward movement during the time the other plunger is being moved inwardly to cause delivery of fuel. While it is possible to effect this modification with a two plunger pump, the maximum displacement of fuel will be cut by more than a half and therefore it is preferred to employ at least another pair of plungers. For a four cylinder engine there will therefore be four plungers and four cam lobes, for a five cylinder engine there will be five plungers and five cam lobes with two or three plungers performing the pumping operation and for a six cylinder engine there will be six plungers and six cam lobes.

Figure 2:
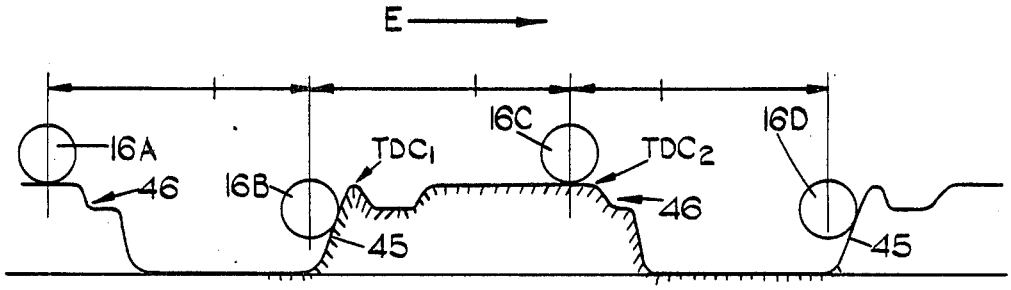
FIG. 2 is a developed view of part of the apparatus of FIG. 1 and modified in accordance with the invention.

FIG. 2 shows an apparatus having four plungers it being understood that only the rollers associated with the plungers are shown. For convenience, the rollers are referenced 16A, 16B, 16C and 16D and they are equi-angularly spaced about the axis of rotation of the distributor member. The cam lobes which perform the pumping action are referenced 45 and these are diametrically disposed, and as shown in FIG. 2 and assuming that the distributor member and hence the rollers, is moving in the direction of the arrow E, the plunger associated with the rollers 16B and 16D will be moving inwardly to cause delivery of fuel by the apparatus.

The cam lobes which perform the holding function are referenced 46 and it will be seen that these follow in the direction of rotation of the distributor member, the lobes 45.

As a roller moves over the crest of a lobe 45 it is allowed to move outwardly a limited extent to cause a rapid reduction in the pressure in the bores accommodating the plunges and also the passages within the distributor member and housing which are connected therewith in particular the pipeline through which fuel has just been supplied by the apparatus. This reduction in pressure allows a valve in the injection nozzle to close quickly. For a short period the roller is held during which time the delivery passage moves out of register with the outlet and then the roller is moved inwardly again by the lobe 46. The lobes 46 hold the rollers against movement during the time fuel is supplied to the bore which contains the plungers which can move outwardly.

The lobes 46 also hold the rollers while delivery of fuel is being effected. The lobes 46 are shaped and positioned such that they allow outward movement of the rollers which are in engagement therewith to start just before the rollers on the lobes 45 reach the crests thereof. In FIG. 2 the crests of the lobes 45 are spaced by 180°. The lobes 46 are also spaced by 180° but the so called top dead centre positions of the lobes 46 are spaced from the top dead centre positions of the preceding lobes 45 by an angle which is less than 90° in order to ensure that the rollers engaging the lobes 46 start to move outwardly before the rollers engaging the lobes 45 have completed their inward movement.

In FIG. 3 two lobes 45 and 46 are shown adjacent each other. This is not of course the case in practice but it does facilitate the understanding of what happens. The curve 47 represents the effective combined lift of the two lobes during the final period of fuel delivery. It will be observed that the combined lift is reduced and also that the end of delivery occurs earlier than if only the cam lobe 45 where in operation. The reduced delivery can be compensated for by allowing more fuel to flow during the filling period. What is important is that the delivey of fuel following the straight section 48 of the cam lobe 45 terminates more quickly which means that the period during which the flow of fuel is reducing is shorter. In the particular example, pumping stops 1.25° after the end of the substantially constant lift section 48 rather than 3.5° with a single cam. Moreover unloading of the pipeline, referred to earlier as a reduction in pressure but illustrated in FIG. 3 in terms of plunger movement, takes place more quickly after pumping ceases. In the case of the single cam 45 the unloading movement indicated at 50 is completed in 3.8° while the unloading movement indicated at 49 when the invention is applied, is achieved in 2.95°.

In the example shown in FIG. 2 the lobes 45 and 46 are alternately arranged so that the cam ring can be used with an apparatus having two pairs of plungers, the plungers of each pair being diametrically disposed. The effect of this is that while one pair of plungers performs the function of pumping fuel the other pair of plungers is held against the movement until near the end of the delivery period.

If the apparatus is provided with a single pair of plungers the lobes must be rearranged so that the lobes 45 follow each other. Hence one plunger as the distributor member rotates effects pumping of fuel on successive strokes and then deals with the unloading function.

We claim:

1. A fuel injection pumping apparatus for supplying fuel to an internal combustion engine and of the kind comprising a rotary distributor member carried in a surrounding housing, a pair of pumping plungers housed in respective bores in said distributor member, said bores being interconnected at their inner ends, an annular cam ring surrounding the distributor member, cam lobes on the internal peripheral surface of the cam ring for imparting inward movement to rollers associated with the plungers as the distributor member rotates, delivery passage means through which fuel displaced from the bores during the inward movement of the plungers therein can flow to the associated engine and inlet passage means through which fuel can be supplied to the bores from a source of fuel under pressure, said cam lobes being arranged so that one of said plungers is held against movement while the other plunger partakes of inward movement to cause delivery of fuel by the apparatus, and said cam lobes being arranged to allow said one plunger to move outwardly before the other plunger has completed its inward movement, said cam lobes including pumping lobes and holding lobes, said pumping lobes including leading flanks which impart movement to the rollers and associated plungers engaged therewith, the leading flanks of said pumping lobes terminating at the crests of the lobes, trailing flanks extending from said crests, said trailing flanks of the pumping lobes acting to allow outward movement of the rollers and associated plungers for the purpose of pressure reduction in the bores and connected passage means, said holding lobes having crest portions from which extend trailing flanks acting to allow outward movement of the rollers and associated plungers engaged therewith, said holding lobes having leading flanks having a substantially constant profile whereby the rollers and associated plungers engaged therewith will be held against movement, the angular spacing of the crests of the pumping and holding lobes and the angular spacing of the rollers being such that the rollers and associated plungers engaged with the holding lobes can move outwardly slightly before the rollers and associated plungers engaged with the pumping lobes.

* * * * *